US006830002B1

(12) United States Patent
Walker

(10) Patent No.: US 6,830,002 B1
(45) Date of Patent: Dec. 14, 2004

(54) LIFT FOR WATERCRAFT

(76) Inventor: Robert L. Walker, 2436 Chancellor Rd., Richmond, VA (US) 23235

( * ) Notice: Subject to any disclaimer, the term of this patent is extended or adjusted under 35 U.S.C. 154(b) by 0 days.

(21) Appl. No.: 10/615,197

(22) Filed: Jul. 8, 2003

(51) Int. Cl.[7] ..... B63C 7/00
(52) U.S. Cl. ..... 114/44; 405/3
(58) Field of Search ..... 114/44–48; 405/3

(56) References Cited

U.S. PATENT DOCUMENTS

| | | | | | |
|---|---|---|---|---|---|
| 5,090,841 | A | * | 2/1992 | Penick et al. | 405/3 |
| 5,184,914 | A | | 2/1993 | Basta | |
| 5,522,671 | A | * | 6/1996 | Keesling | 405/3 |
| 5,890,835 | A | | 4/1999 | Basta et al. | |
| 5,908,264 | A | | 6/1999 | Hey | |
| 5,915,877 | A | | 6/1999 | Sargent et al. | |
| 5,919,000 | A | | 7/1999 | Unkle | |
| 5,934,826 | A | | 8/1999 | Mansfield | |
| 6,318,929 | B1 | | 11/2001 | Basta | |
| 6,520,728 | B1 | | 2/2003 | Schwitters | |
| 6,543,375 | B1 | | 4/2003 | Sargent et al. | |
| 6,575,661 | B1 | * | 6/2003 | Phillips et al. | 405/3 |
| 6,612,775 | B1 | * | 9/2003 | Hewitt | 405/3 |
| 6,695,533 | B1 | * | 2/2004 | Bulmann | 405/3 |

* cited by examiner

*Primary Examiner*—Andrew D. Wright
(74) *Attorney, Agent, or Firm*—John H. Thomas, P.C.

(57) ABSTRACT

A lift for watercraft has raised and lowered positions and is adapted to be mounted in a body of water. The lift has a substantially rectangular base with first and second pairs of vertical corner posts that are connected to and carry longitudinal beams. The base further has two transverse beams connected to the longitudinal beams. A pivoting cradle is attached to the base. Watercraft support bunk are connected to the cradle. A pair of actuators is connected on one end to the pivoting cradle and on the other end to one of the first pair of corner post. The first pair of corner posts is adapted to be long enough that at least a portion of the corner posts is above a water level of a body of water in which the lift is mounted, and the actuators are connected to the first pair of corner posts in the portion of the corner posts above the water level.

9 Claims, 7 Drawing Sheets

LIFT FOR WATERCRAFT

The present invention relates to lifts for watercraft, and specifically to lifts for both raising watercraft out of water for storage and lowering watercraft into water for use.

BACKGROUND OF THE INVENTION

There are many benefits obtained from storing a watercraft out of water when it is not in use. In the water, a watercraft may be subjected to physical, abrasive damage from contact with pilings and docks, particularly if there is a storm or otherwise choppy weather. Slow leaks may develop that can both damage the operation of the boat or cause sinking through leakage into the boat or may damage the environment if contaminants such as fuel or lubricants leak from the boat. There is also the corrosive effect of algae in fresh water and, if salt or brackish water, then barnacles and other marine growth.

Accordingly, it is well recognized that owners of watercraft preferably take their watercraft out of water when not in use. There are many types of dry storage and dry dock configurations available. On an individual level, some owners use lifts that raise their watercraft above the water level and hold them there between use. Boat lifts may be in the form of slings or other systems that lift the boat out of the water.

Some common types of boat lifts have an actuation system that is mounted, at least primarily, under the water level. These actuation systems connect to a base that rests on the bottom of the body of water. A pivoting type of platform is attached to the base to raise and lower the watercraft on it. Conventionally, the platform is moved upwardly and downwardly by a hydraulic system that is mounted onto the base of the assembly and underwater. In some designs, the hydraulic piston uses extension force, i.e., the rod pushes up the platform as the rod is extended out of the cylinder during the raising of the platform. Accordingly, when in the raised, storage position, the rod is exposed out of the cylinder. Since the raised/storage position is the most common position (as the boat platform is only lowered during use), then the rod is typically exposed out of the hydraulic cylinder for a majority of the time. During this exposure, foreign matter, corrosion, dirt, marine growth or some other form of contamination can develop on the rod. The entire hydraulic assembly could possibly be damaged or at least have its efficiency reduced through the action of drawing the rod and any accumulated contamination back into the cylinder damaging seals, o-rings, and other cylinder parts that maintain system pressure. Importantly, in a system having hydraulic fluid that is not water soluble, there are oils or other contaminants that may leak into the water.

Another drawback in previous boat lifts where the hydraulic cylinder is mounted on the base of the lift is that there is a certain amount of water depth required when the actuated system is located substantially below the water. Therefore, for the previous boatlifts to achieve a greater lift range would require more water depth or significant design change.

A further drawback with actuation systems mounted on the bottom of a support frame is that the only access to the hydraulic system is underwater. For purposes of installation, inspection, maintenance or repair, it can be inconvenient to work underwater. Also there can be fouling or damage on or around the actuation system that is not visible and can only occur when the system is underwater. Actuation under these conditions could possibly cause accidental harm to the user, the boat, or the entire system because it is not visible to the user.

SUMMARY OF THE INVENTION

Accordingly, it is an object of the present invention to provide a lift for watercraft that overcomes the foregoing drawbacks. The lift of the present invention utilizes an actuator that pulls a cradle that is adapted to hold a watercraft out the water and holds it in a raised position out of the water. Additionally, the actuator itself is mounted such that it is above the base and substantially above the water level of the body of water in which the lift is located.

In one embodiment, a lift for watercraft has raised and lowered positions and is adapted to be mounted in a body of water. The lift comprises a substantially rectangular base having first and second pairs of vertical corner posts that are connected to and carry longitudinal parallel beams. The base further has two transverse beams connected to the longitudinal beams. The lift also includes a pivoting cradle attached to the base and watercraft support bunks connected to the pivoting cradle. The lift further includes a pair of actuators, each connected on one end to the pivoting cradle and on its other end to one of the first pair of corner posts. The actuators are operable for rotating the cradle upward and past its pivotable connection to the base to a raised lift position, wherein the raised lift position is over center. Further, each of the first pair of corner posts is adapted to be long enough that at least a portion of the corner posts is above a water level of the body of water in which the lift is mounted, and the actuators are connected to the corner posts in the portion of the corner posts above the water level. The lift may further include cradle retainers mounted on the first pair of corner posts, the retainers adapted to support the cradle in the raised lift position. The watercraft support bunks may be mounted on an angle onto the pivoting cradle. The actuators may be bidirectional hydraulic cylinders. Those hydraulic cylinders may have rods that move in an extension direction when the rods extend out of the cylinder and move in a retraction direction when the rods retract into the cylinder, and wherein the upward rotation of the cradle to the raised lift position is created by movement in the retraction direction of the rods into the cylinders. The rods may be substantially completely retracted into the cylinders when the lift is in the raised position. Each of the corner posts may comprise a telescoping leg whereby the lift height and level may be adjusted. The actuators may be above the water level when the lift is in the raised position.

In an alternative embodiment, the present invention includes a lift for raising a cradle on which a watercraft may be supported above a water level of a body of water for storage of a watercraft out of the water. The lift also may be used for selectively lowering the cradle into the body of water. The lift comprises a hydraulic cylinder having a rod for raising and lowering the cradle. The rod is moveable between a retracted position wherein the rod is substantially within the cylinder and an extended position wherein the rod is substantially outside the cylinder. The cradle is in a raised position when the rod is in the retracted position. The hydraulic cylinder is above the level of the body of water when the rod is in the retracted position.

DETAILED DESCRIPTION

Figure 1:
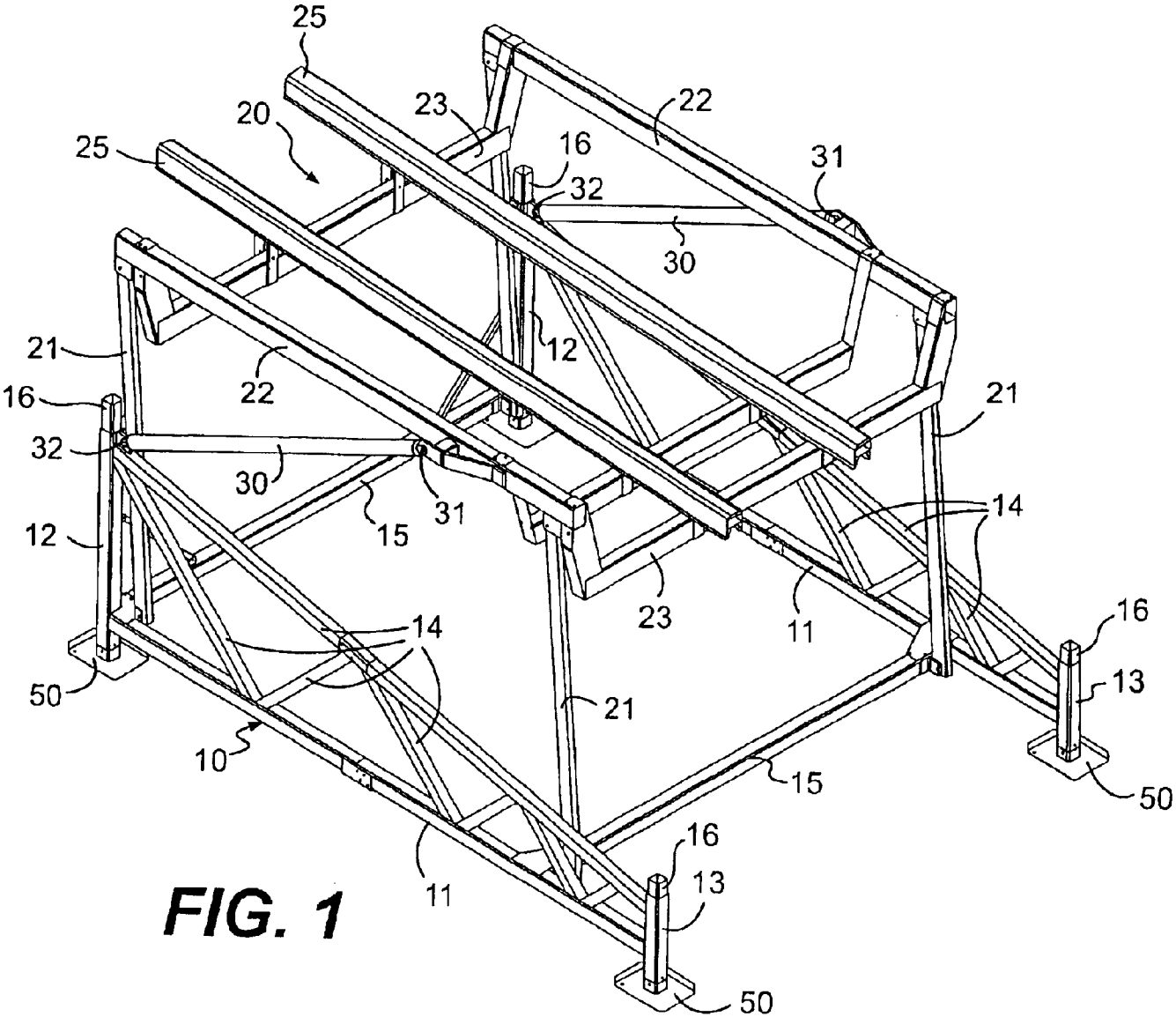
FIGS. 1–3 are perspective views of an embodiment of a watercraft lift of the present invention wherein the lift is shown in the raised, partially lowered, and lowered positions respectively.
Figure 2:
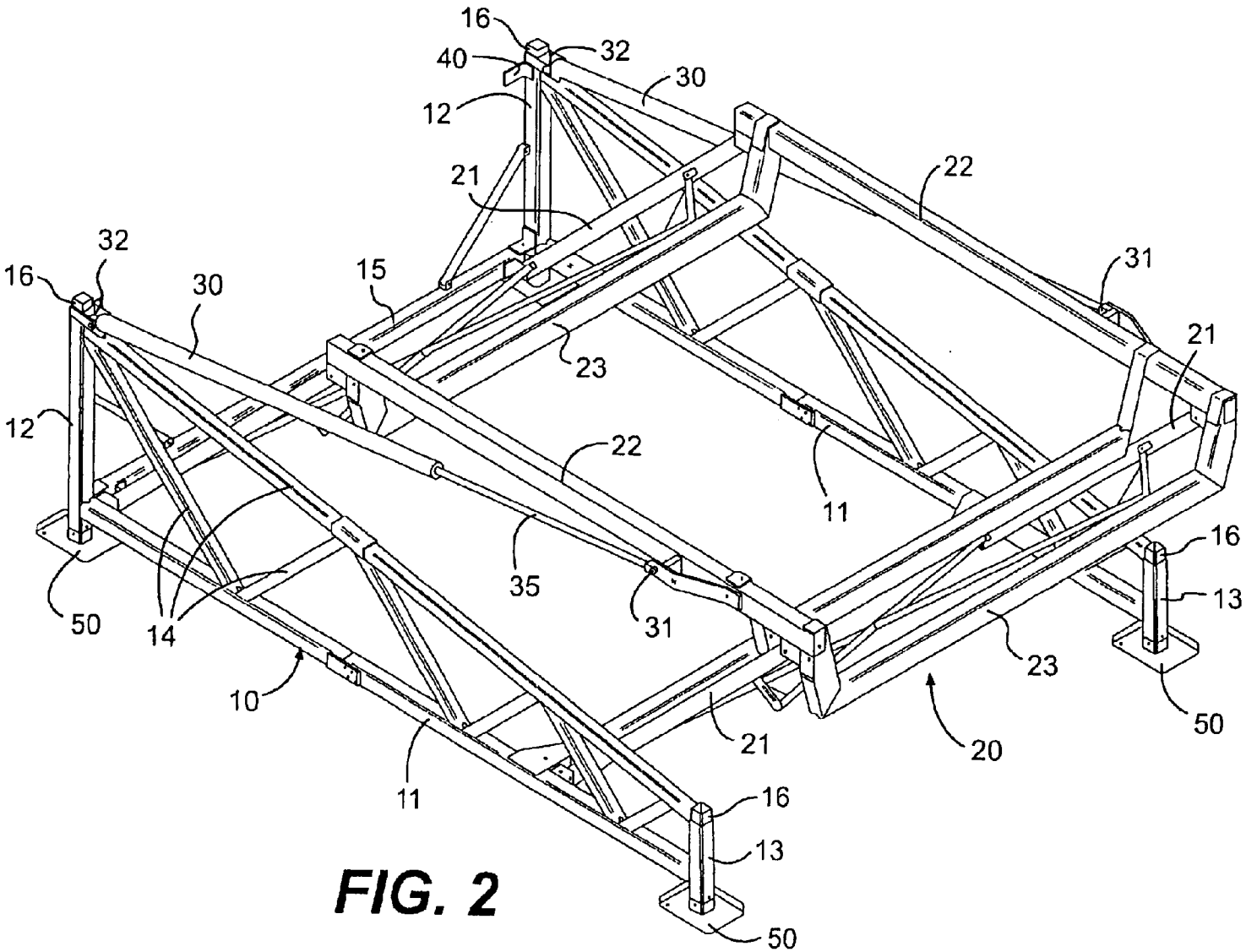

The present invention will be described in the context of a particular embodiment. Variations of the structure described herein and illustrated in the attached drawings may be evident to a construction engineer of skill in this art. These variations are considered to be in the scope of the present invention.

Reference is now made to FIGS. 1–6 which display a particular embodiment of the present invention, a boat lift, in multiple views and positions. Of course, other types of watercraft may be stored on similar structures. The boat lift consists of a base 10 and a cradle 20 that is connected in a pivoting fashion to the base. The base 10 has a substantially rectangular construction. The base 10 has first and second pairs of vertical corner posts 12 and 13 that are connected to and carry longitudinal parallel beams 11. Base 10 is further constructed of two transverse beams 15 connected on each end to the longitudinal beams 11. As illustrated in the drawings, the longitudinal beams 11 are fixedly secured to the corner posts 12 and 13 toward the bottom of those corner posts. The lower that transverse beams 15 can be mounted, the more shallow the water that the lift may be placed in. For this reason, the longitudinal beams 11 and transverse beams 15 are mounted at or near the lower end of the vertical corner posts 12 and 13. The base 10 further includes structural frames 14 that make the base more secure and rigid. As shown in figures, the frames 14 are angled from a relatively higher position at the first pair of vertical corner posts 12 to a relatively lower position attached to the second pair of corner posts 13.

The design of the first and second pairs of corner posts 12 and 13 may be different. As shown in the figures, corner posts 12 are longer than corner posts 13. The corner posts 12 are adapted to be long enough to extend above the water level of the body of water in which the lift is mounted. When the lift is mounted in water that is subject to tidal fluctuations, it is preferred that the corner posts 12 are long enough to extend above the water level at high tide. Of course, it is impossible to predict the highest water levels that may occur in the event of flooding or other unanticipated conditions, but the length of the corner posts 12 is adapted to be long enough that the posts extend out of the water and above the ordinary water level or high tide water level. The second pair of corner posts 13 may be shorter than corner posts 12 so that cylinder rods 35 may extend fully and lower the cradle 20 to launch or accept a boat for lifting to the storage position.

Telescoping legs 16 have feet 50 at their base. The telescoping legs 16 are attached to the feet 50 and telescope inside the hollow corner posts 12 and 13. The telescoping legs 16 may be allowed to move up and down in the corner posts 12 and 13 by any conventional telescoping means. In one embodiment, a pin and hole configuration may be adapted to allow the positioning of the base 10 to be leveled on an uneven bottom of a body of water. The telescoping legs 16 in the corner posts 13 and 12 also allow for the height of the base 10 to be varied depending on the depth of the water in any particular location where the lift will be mounted. Telescoping legs 16 also allow for the height of base 10 to be varied depending on the depth of the water at each leg of the desired height of the cradle above the water to respond to such conditions as pier height and prevailing water conditions.

Figure 4:
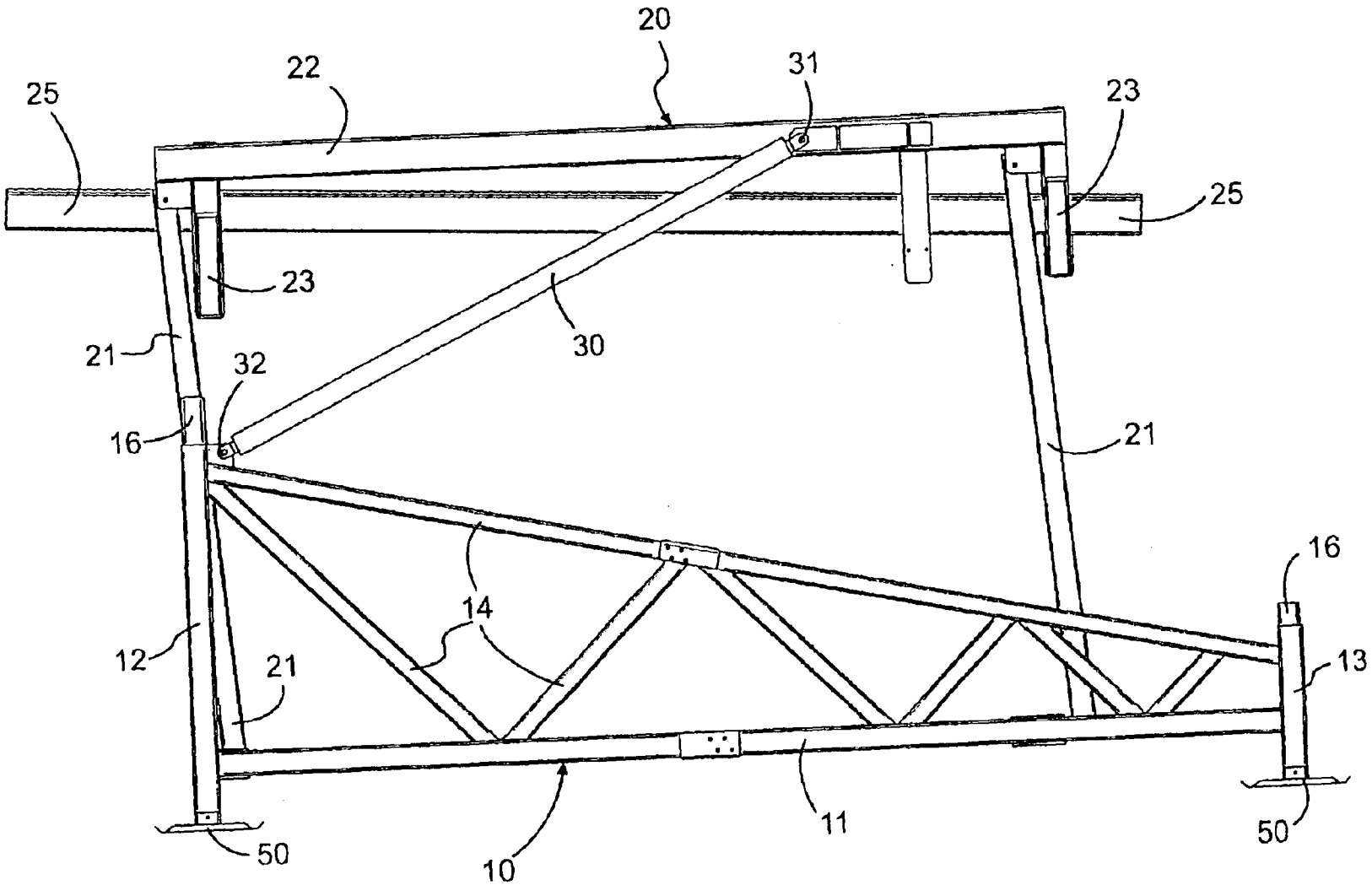
FIGS. 4 and 5 are side elevation views of a lift in accordance with an embodiment of the present invention in the raised and partially lowered positions respectively.
Figure 5:
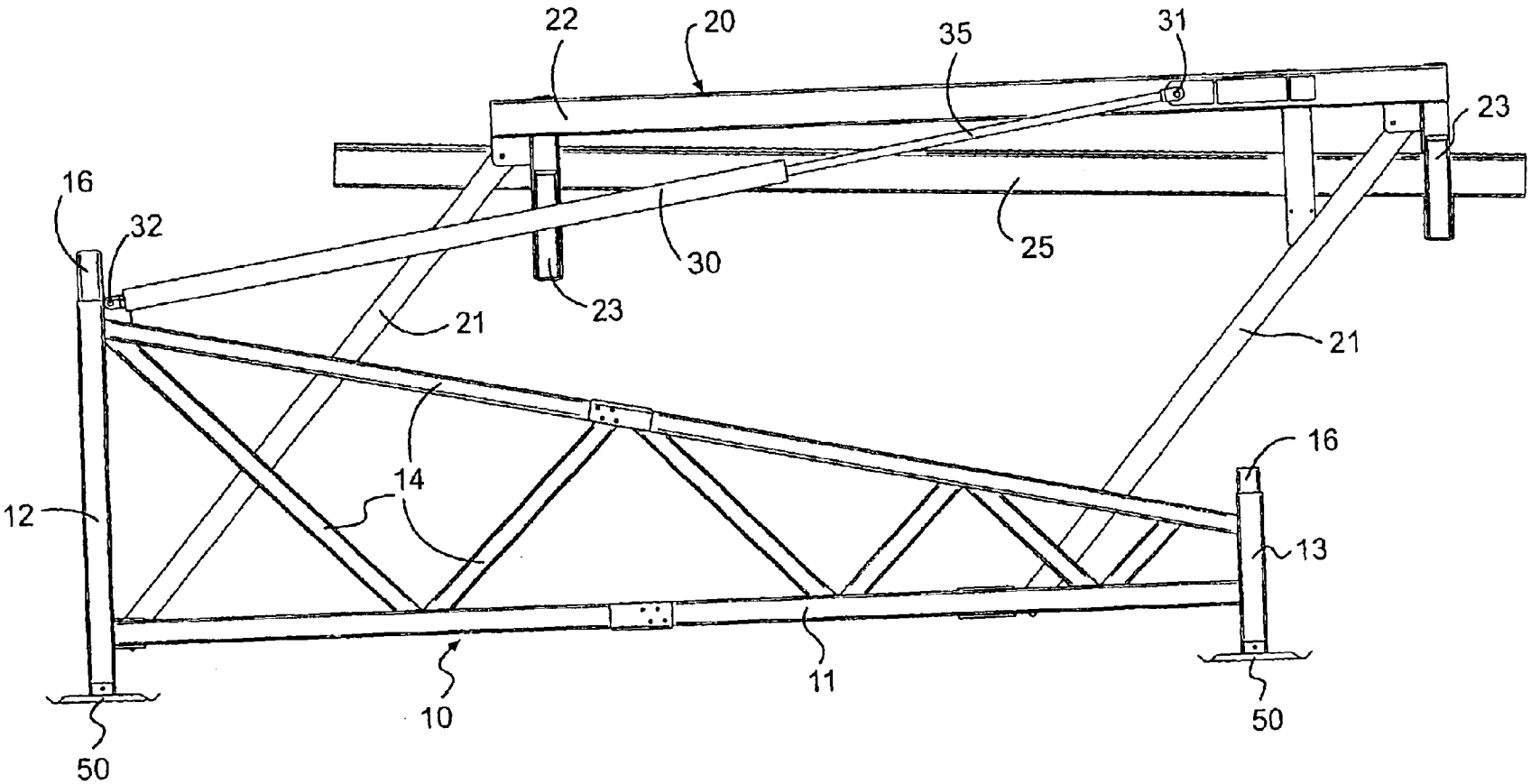
Figure 6:
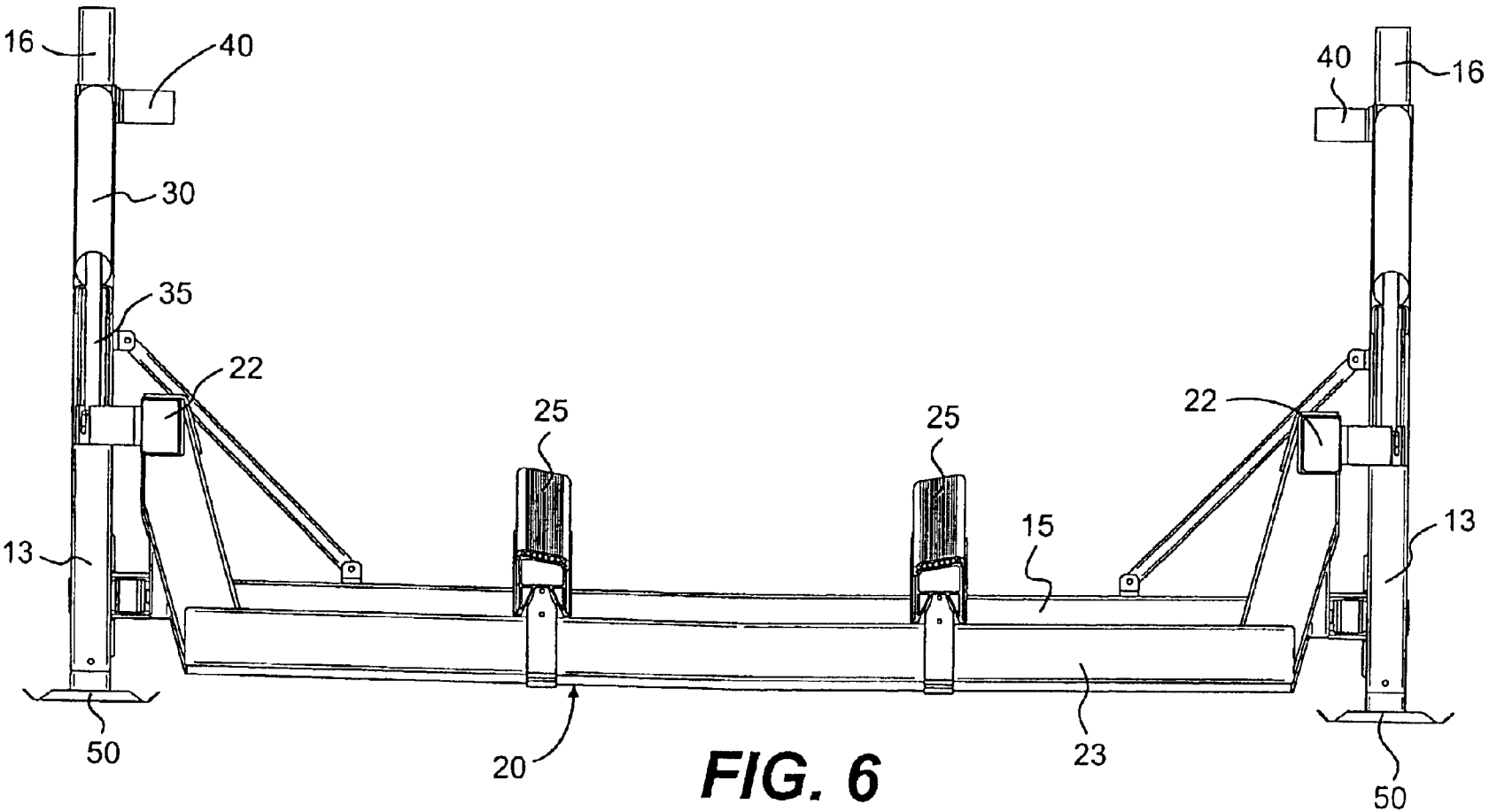
FIG. 6 is a front elevation of a lift in accordance with an embodiment of the present invention when the lift is in the lowered position.

The cradle 20 is made up of support arms 21 connected in a pivoting fashion to the transverse beams 15. The cradle 20 further includes a rectangular platform defined by longitudinal supports 22 and transverse supports 23. The transverse supports 23 of the cradle 20 further have boat support bunks 25 attached thereto. As shown in FIGS. 4 and 5, the support bunks 25 may be mounted on an angle onto the transverse beams 23 of the cradle 20. The angled bunks 25 facilitate support of a boat. They also encourage drainage of water out of a boat during storage, assuming a bilge pump or a drain plug at the stem of the boat hull. The mounting angle of the bunks is adjustable to accommodate boats of different size and design.

Figure 3:
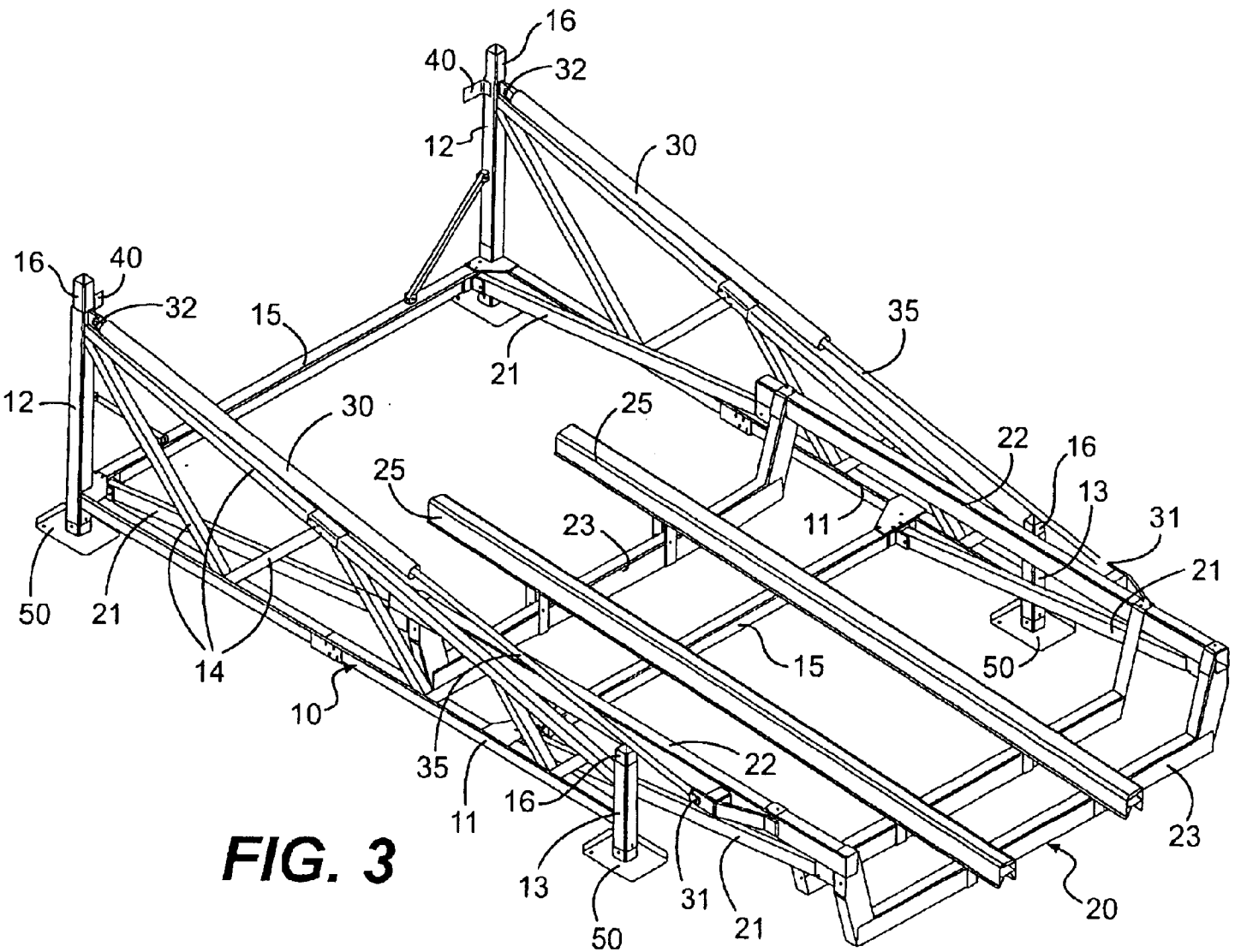

A pair of actuators 30 is connected on one end to the pivoting cradle 20 by way of a rotatable pin 31. The actuators 30 are connected on the other end to the top of the first pair of corner posts 12 by a rotatable pin 32. As shown, the actuators 30 are hydraulic cylinders that include rods 35 that are drawn into and out of each hydraulic cylinder 30. The actuators 30 are bidirectional in that they may be actuated to extend the rod 35 out of the cylinder 30 by an extension force. The cylinders 30 may also draw the rod 35 into the hydraulic cylinder 30 by means of a retraction force. As illustrated in the figures, when the cradle 20 is in its lowered position as shown in FIG. 3, the rod 35 is substantially extended out of the cylinder 30. The cradle 20 is raised through the action of the retraction of the cylinder of the actuator 30 in drawing the rod 35 into the hydraulic cylinder 30. As demonstrated in FIG. 1, rod 35 is not visible as it is substantially fully withdrawn into the cylinder 30. FIG. 1 illustrates the raised position of the cradle 20 and, therefore, the boat lift.

As shown especially in FIG. 4, when the cradle 20 is also in the up and raised position, the support arms 21 have been rotated past their pivotal connections such that the cradle (lift) is over center. In addition to being retained in this raised, over center position by the actuator 30, there are retainers 40 that are brackets fixed to the first pair of corner posts 12 which the support arms 21 may rest against in the raised position. In this way, the actuator 30 does not bear all of the weight and forces required to retain the cradle 20 in the raised position.

The raising of the cradle 20 by means of a retraction of the actuator 30 attached above the frame allows for a longer lift range and resultant higher storage height from the same bottom cradle position than that of the prior art. The higher storage position is much preferred for safer boat storage above the water in tidal areas, other areas of fluctuating water levels and areas subject to wind and storm conditions.

The actuator 30 is attached to the corner posts 12 at substantially the top of those posts. In this way, the actuator 30 is above or substantially above the water level in which the lift will be placed. It Is also significant that, when in the raised position, the actuator 30 is out of the water (or substantially out of the water depending on weather or tidal fluctuations) because of its position above the water level and the rod 35 is in the fully retracted position. In this way, the rod 35 is protected from corrosion or other fouling when in the raised position.

Figure 7:
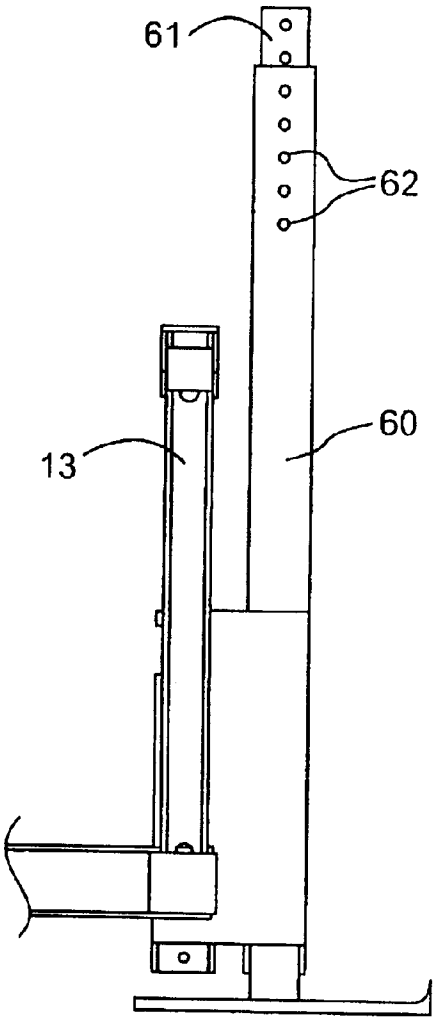
FIG. 7 is a front elevation view of an alternative construction of a vertical corner post having a supplemental support.

As shown in FIG. 7, in an alternative embodiment, the second pair of corner posts 13 may have a supplemental vertical support 60 located outboard of the frame. This means that the rod 35 may extend fully over the frame and allows a substantial amount of height variation of the foot 50 as with corner posts 12. The supplemental vertical support 60 may be welded or bolted to the corner posts 13 as shown in FIG. 7. The supplemental supports 60 have a greater length which allows for a longer post 61 to telescope therein. This then allows for greater variability in the mounting height of the base 10 in a body of water.

FIG. 7 also displays holes 62 in telescoping legs 61 that may be used in connection with a pin (not shown) and corresponding holes 62 in the support 60 to vary the height of the base 10. This same type of pin in hole configuration may also be used to raise and lower and variably fix the height of legs 16.

In one embodiment, the components are made of galvanized steel. The components have been designed and assembled through structural optimization of size and length of components, points of and method of attachment of cylinders, rods, and components to allow a boat to be raised 7 feet from the bottom position of the cradle. In this exemplary construction, the actuators 30 are hydraulic cylinders having the following specifications: 0–3000 psi. The particular power supply consisting of pump, motor, reservoir, battery, charger and controls that are used to drive and coordinate the actuators 30 are provided in an enclosed housing (not shown). These foregoing components are adapted to lift 10,000 pounds.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A lift for watercraft having raised and lowered positions and adapted to be mounted in a body of water, the lift comprising:

a) a substantially rectangular base having first and second pairs of vertical corner posts that are connected to and carry longitudinal beams, the base further having two transverse beams connected to the longitudinal beams;

b) a pivoting cradle attached to the base;

c) watercraft support bunks connected to the pivoting cradle;

d) a pair of actuators each comprising a cylinder and a rod, wherein each cylinder has two ends, a first end opposite a second end, the second end having an aperture that receives the rod, and wherein each rod has two ends, a first end opposite a second end, the second end being retractable into the cylinder, the first end of the rod connected to the pivoting cradle and the first end of the cylinder connected to one of the first pair of corner posts and the cylinder terminates at the corner post, wherein each cylinder remains at all times completely within a perimeter defined by the rectangular base, the actuators being operable for rotating the cradle upward and past its pivotal connection to the base to a raised lift position, wherein the raised lift position is overcenter;

e) wherein each of the first pair of corner posts is adapted to be long enough that at least a portion of the corner posts is above a water level of the body of water in which the lift is mounted, and the actuators are connected to the corner posts in the portion of the corner posts above the water level.

2. The lift for watercraft described in claim 1, further comprising cradle retainers mounted on the first pair of corner posts, the retainers adapted to support the cradle in the raised lift position.

3. The lift for watercraft described in claim 1, wherein the watercraft support bunks are mounted on an angle onto the pivoting cradle.

4. The lift for watercraft described in claim 1, wherein the actuators are bidirectional hydraulic cylinders.

5. The lift for watercraft described in claim 4, wherein the cylinders have rods that move in an extension direction when the rods extend out of the cylinder and move in a retraction direction when the rods retract into the cylinder; and wherein the upward rotation of the cradle to the raised lift position is created by movement in the retraction direction of the rods into the cylinders.

6. The lift for watercraft described in claim 5, further wherein the rods are substantially completely retracted into the cylinders when the lift is in the raised position.

7. The lift for watercraft described in claim 1, wherein each of the corner posts comprises a telescoping leg whereby the lift height and level may be adjusted.

8. The lift for watercraft described in claim 1, wherein the actuators are above the water level when the lift is in the raised position.

9. A lift for raising a cradle on which a watercraft may be supported above a water level of a body of water for storage of the watercraft out of the water and for selectively lowering the cradle into the body of water, the lift comprising:

a rectangular base pivotally connected to and supporting the cradle;

a hydraulic cylinder having a rod retractable therein and extendible therefrom for raising and lowering the cradle, the cylinder having two ends, a first end opposite a second end, the second end having an aperture that receives the rod; the rod having two ends, a first end opposite a second end, the second end being retractable into the cylinder; the first end of the cylinder connected to and terminating at the base and the first end of the rod connected to the cradle, wherein the cylinder remains at all times completely within a perimeter defined by the rectangular base, the rod being moveable between a retracted position wherein the rod is substantially within the cylinder and an extended position wherein the rod is substantially outside the cylinder, the cradle being in a raised position when the rod is in the retracted position; and wherein the hydraulic cylinder is substantially above the level of the body of water when the rod is in the retracted position.

* * * * *